US010060595B1

(12) United States Patent
Martin

(10) Patent No.: US 10,060,595 B1
(45) Date of Patent: Aug. 28, 2018

(54) PERSONALIZED LAMP

(71) Applicant: Otis Martin, Coshocton, OH (US)

(72) Inventor: Otis Martin, Coshocton, OH (US)

( * ) Notice: Subject to any disclaimer, the term of this patent is extended or adjusted under 35 U.S.C. 154(b) by 73 days.

(21) Appl. No.: 15/345,662

(22) Filed: Nov. 8, 2016

(51) Int. Cl.

| | |
|---|---|
| ***F21V 1/10*** | (2006.01) |
| ***F21S 6/00*** | (2006.01) |
| ***F21V 1/12*** | (2006.01) |
| ***F21V 17/06*** | (2006.01) |
| ***F21V 17/00*** | (2006.01) |
| ***F21V 23/00*** | (2015.01) |
| *F21W 121/00* | (2006.01) |

(52) U.S. Cl.
CPC ..... *F21V 1/10* (2013.01); *F21S 6/002* (2013.01); *F21V 1/12* (2013.01); *F21V 17/002* (2013.01); *F21V 17/06* (2013.01); *F21V 23/002* (2013.01); *F21W 2121/00* (2013.01)

(58) Field of Classification Search
CPC ..... F21V 17/002; F21V 17/06; F21V 1/12; F21V 23/002; F21S 6/002; F21W 2121/00
USPC ..... 362/269, 285, 284, 282
See application file for complete search history.

(56) References Cited

U.S. PATENT DOCUMENTS 2,177,204 A 10/1939 Buzick
3,879,874 A * 4/1975 Broussard, Sr. ..... B44C 3/025 40/768
5,695,066 A 12/1997 Bartlett
6,113,249 A 9/2000 Ziegler
6,204,439 B1 * 3/2001 Chen ..... A63H 13/20 446/366
D457,982 S 5/2002 Copeland
6,821,002 B1 11/2004 Morgen
8,931,192 B2 1/2015 Acworth
2002/0105808 A1 * 8/2002 Ting Yup ..... F21S 10/02 362/281
2004/0109316 A1 * 6/2004 Lin ..... F21S 10/00 362/253
2009/0135586 A1 * 5/2009 Yang ..... F21S 10/002 362/101
2014/0268663 A1 * 9/2014 Yang ..... F21S 10/002 362/101
2015/0267901 A1 * 9/2015 Cohen ..... F21S 6/002 362/282
2015/0338085 A1 * 11/2015 Frederick ..... F21V 1/00 362/382
2016/0010819 A1 * 1/2016 Yang ..... F21S 10/002 362/101

* cited by examiner

*Primary Examiner* — Julie Bannan
(74) *Attorney, Agent, or Firm* — Kyle A. Fletcher, Esq.

(57) ABSTRACT

The personalized lamp is a table lamp wherein the lampshade is able to rotate. The lampshade features a plurality of picture windows that encircle a lower portion of the lampshade. The plurality of picture windows enables pictures to be inserted therein, and rotate along with the lampshade when in use. The personalized lamp includes a base atop of which a pair of baby shoes is affixed. A vertical member of cylindrical construction extends upwardly from the base. A motor is housed where the vertical member extends from the base. The motor is in mechanical connection with a motor shaft that extends vertically within the vertical member. A rotating bushing is affixed to the motor shaft. The rotating bushing is atop of the vertical member. The rotating bushing is attached to shade arms that connect to the lampshade. A light socket is positioned above the rotating bushing.

13 Claims, 4 Drawing Sheets

PERSONALIZED LAMP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lamps, more specifically, a personalized lamp.

SUMMARY OF INVENTION

The personalized lamp is a table lamp wherein the lampshade is able to rotate. The lampshade features a plurality of picture windows that encircle a lower portion of the lampshade. The plurality of picture windows enables pictures to be inserted therein, and rotate along with the lampshade when in use. The personalized lamp includes a base atop of which a pair of baby shoes is affixed. A vertical member of cylindrical construction extends upwardly from the base. A motor is housed where the vertical member extends from the base. The motor is in mechanical connection with a motor shaft that extends vertically within the vertical member. A rotating bushing is affixed to the motor shaft. The rotating bushing is atop of the vertical member. The rotating bushing is attached to shade arms that connect to the lampshade. A light socket is positioned above the rotating bushing. Unlike the motor shaft and the rotating bushing, the light socket and the vertical member do not rotate.

It is an object of the invention to provide a table lamp that is able to display a plurality of photographs or pictures from any of the plurality of picture windows provided on a lower portion of the lampshade.

It is a further object of the invention to provide a mechanical means for rotation of the lampshade relative the base and vertical member.

These together with additional objects, features and advantages of the personalized lamp will be readily apparent to those of ordinary skill in the art upon reading the following detailed description of the presently preferred, but nonetheless illustrative, embodiments when taken in conjunction with the accompanying drawings.

In this respect, before explaining the current embodiments of the personalized lamp in detail, it is to be understood that the personalized lamp is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the personalized lamp.

It is therefore important that the claims be regarded as including such equivalent construction insofar as they do not depart from the spirit and scope of the personalized lamp. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
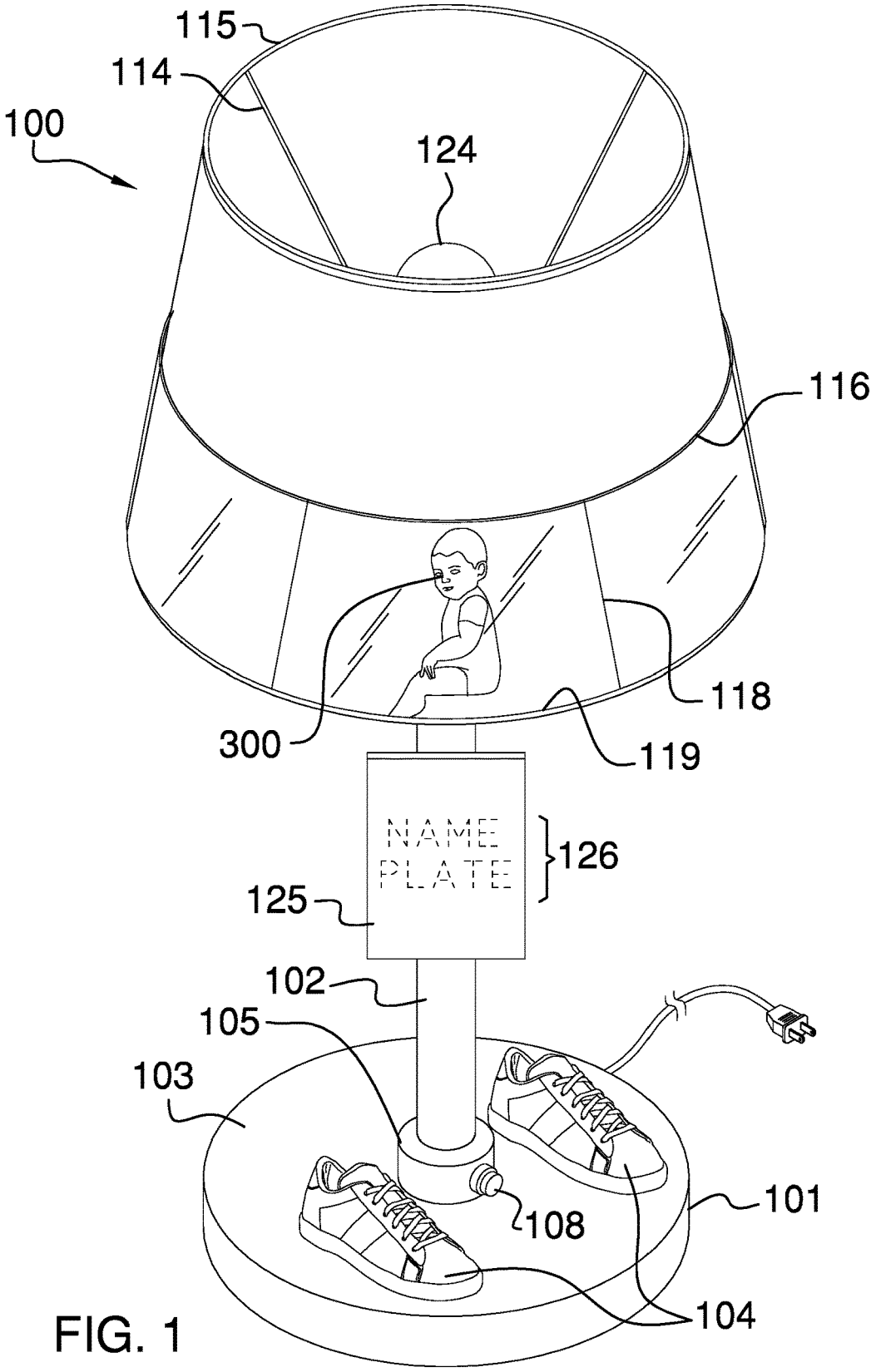
FIG. 1 is a perspective view of an embodiment of the disclosure.
Figure 2:
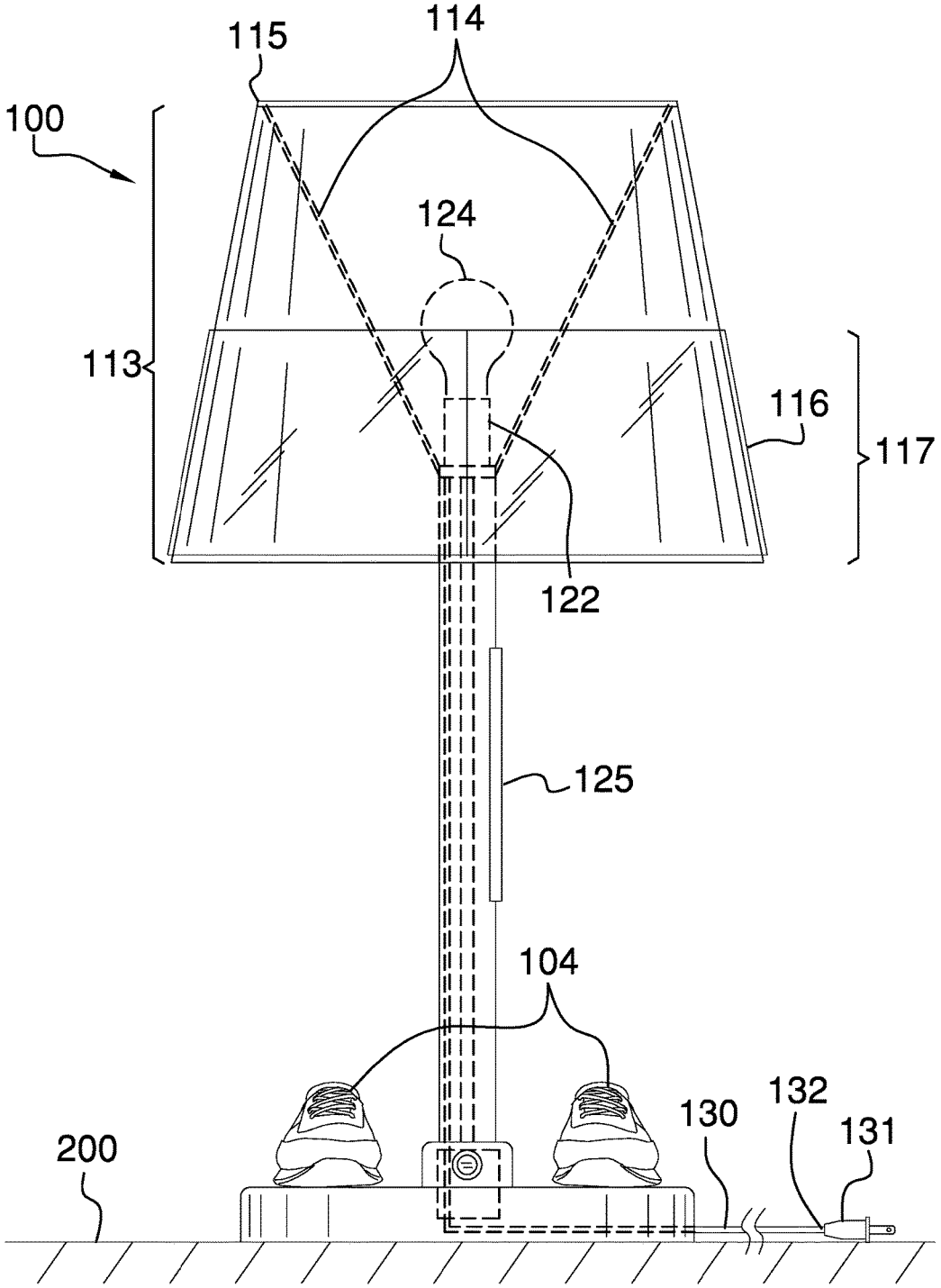
FIG. 2 is a side view of an embodiment of the disclosure.
Figure 3:
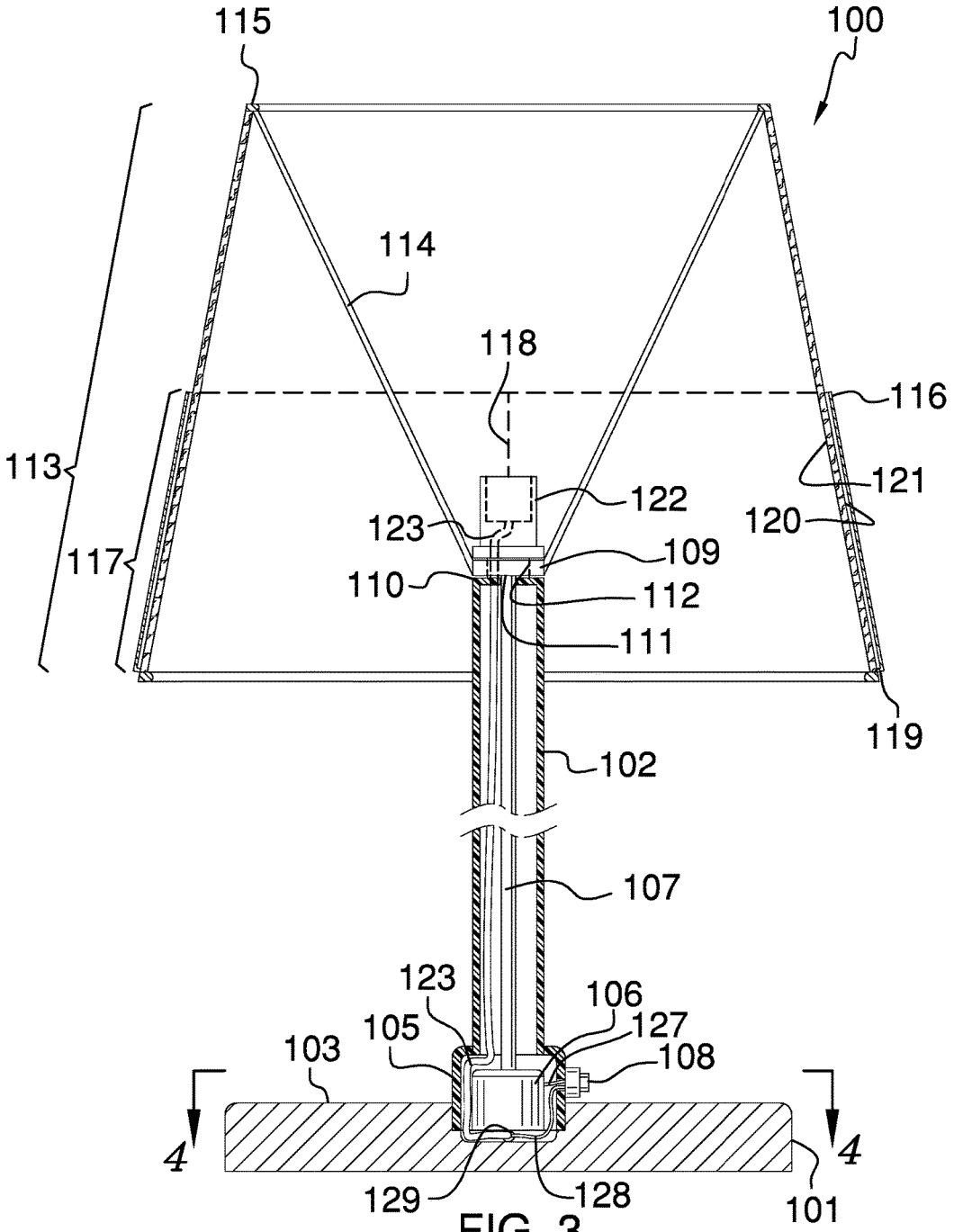
FIG. 3 is a cut-away view of an embodiment of the disclosure.
Figure 4:
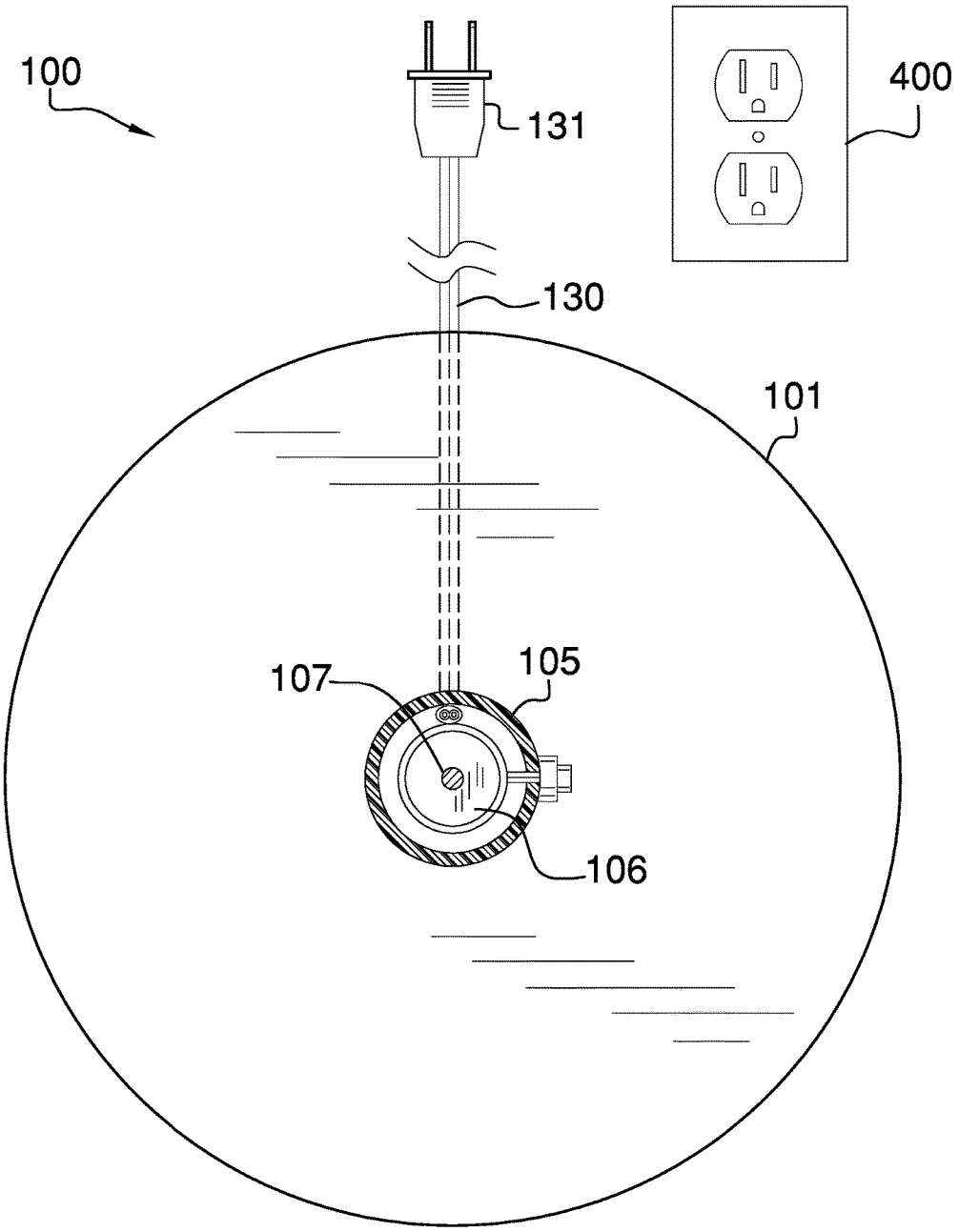
FIG. 4 is a cross-sectional view of an embodiment of the disclosure along line 4-4 in FIG. 3.

Detailed reference will now be made to one or more potential embodiments of the disclosure, which are illustrated in FIGS. 1 through 4.

The personalized lamp 100 (hereinafter invention) comprises a base 101 that is configured to lie on a surface 200. The base 101 supports a vertical member 102. The vertical member 102 is perpendicular with respect to the base 101. The base 101 has a circular shape, and is further defined with a top base surface 103. A pair of baby shoes 104 is affixed to the top base surface 103 of the base 101. The vertical member 102 is a cylindrically-shaped object that extends vertically from the base 101. Moreover, the vertical member 102 is centrally aligned with respect to the base 101.

A motor housing 105 interfaces between the base 101 and the vertical member 102. The motor housing 105 houses a motor 106 within. The motor 106 is in mechanical connection with a motor shaft 107. The motor shaft 107 extends vertically from the motor 106. Moreover, the motor shaft 107 extends upwardly within the vertical member 102. The motor housing 105 includes a first switch 108 thereon. The first switch 108 is responsible for powering the motor 106.

The vertical member 102 extends vertically. A rotating bushing 109 rest atop of a top distal end 110 of the vertical member 102. The rotating bushing 109 is affixed to a top shaft end 111 of the motor shaft 107. The rotating bushing

109 is able to rotate atop of the vertical member 102. The rotating bushing 109 is a disk-shaped object, which is further characterized with an inner circle 112.

The invention 100 includes a lampshade 113. The lamp shade 113 is attached to the rotating bushing 109 via a plurality of shade arms 114. The plurality of shade arms 114 extend upwardly as well as outwardly with respect to the vertical member 102. Each of the plurality of shade arms 114 is constructed of rod members, and extends to a top, edge 115 of the lampshade 113. The top, edge 115 of the lampshade 113 defines the topmost portion of the invention 100.

The lampshade 113 is of unique construction. The lampshade 113 includes a plurality of picture windows 116. The plurality of picture windows 116 occupy a bottom portion 117 of the lampshade 113. The plurality of picture windows 116 is constructed of a translucent material, and has a shape of a truncated cone, which is optionally removed from the lampshade 113. The plurality of picture windows 116 is able to slide upwardly and separate from the lampshade 113 as needed. The plurality of picture windows 116 includes vertical partitions 118 to separate each window from one another. The plurality of picture windows 116 includes a bottom lip 119, which prevents photos or pictures 300 from falling out from between an outer lampshade surface 120 of the lampshade 113 and an inner window surface 121 of the respective one of the plurality of picture windows 116.

Seated atop of the rotating bushing 109 is a light socket 122. The light socket 122 includes light wiring 123 that extends down through the inner circle 112 of the rotating bushing 109, and inside of the vertical member 102. The light socket 122 is configured to receive a light bulb 124. The vertical member 102 includes a name plate 125 affixed thereon. The name plate 125 is configured to receive indicia 126 thereon. The indicia 126 being a name of an individual associated with the pair of baby shoes 104.

The motor 106 includes a motor wire 127 that extends from the motor 106 to the first switch 108. The first switch 108 includes a switch wire 128. Both the switch wire 128 and the light wiring 123 connect at a junction 129. An electrical cord 130 connects to and extends from the junction 129. The electrical cord 130 extends from the base 101. A plug 131 is provided at a distal end 132 of the electrical cord 130. The plug 131 is configured to interface with a standard electrical outlet 400.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lamp comprising:

a base with a vertical member;

wherein a lamp shade is able to rotate atop of said vertical member;

wherein the base is configured to lie on a surface; wherein the base supports the vertical member;

wherein the vertical member is perpendicular with respect to the base;

wherein the base has a circular shape, and is further defined with a top base surface;

wherein a pair of baby shoes is affixed to the top base surface of the base;

wherein the vertical member is a cylindrically-shaped object that extends vertically from the base;

wherein the vertical member is centrally aligned with respect to the base;

wherein a motor housing interfaces between the base and the vertical member;

wherein the motor housing houses a motor within;

wherein the motor is in mechanical connection with a motor shaft;

wherein the motor shaft extends vertically from the motor;

wherein the motor shaft extends upwardly within the vertical member;

wherein the motor housing includes a first switch thereon;

wherein the first switch is responsible for powering the motor.

2. The lamp according to claim 1 wherein the vertical member extends vertically; wherein a rotating bushing rest atop of a top distal end of the vertical member.

3. The lamp according to claim 2 wherein the rotating bushing is affixed to a top shaft end of the motor shaft; wherein the rotating bushing is able to rotate atop of the vertical member; wherein the rotating bushing is a disk-shaped object, which is further characterized with an inner circle.

4. The lamp according to claim 3 wherein the lampshade is attached to the rotating bushing via a plurality of shade arms.

5. The lamp according to claim 4 wherein the plurality of shade arms extend upwardly as well as outwardly with respect to the vertical member; wherein each of the plurality of shade arms is constructed of rod members, and extends to a top, edge of the lampshade.

6. The lamp according to claim 5 wherein the lampshade includes a plurality of picture windows.

7. The lamp according to claim 6 wherein the plurality of picture windows occupy a bottom portion of the lampshade; wherein the plurality of picture windows is constructed of a translucent material, and has a shape of a truncated cone, which is optionally removed from the lampshade.

8. The lamp according to claim 7 wherein the plurality of picture windows is able to slide upwardly and separate from the lampshade as needed.

9. The lamp according to claim 8 wherein the plurality of picture windows includes vertical partitions to separate each window from one another; wherein the plurality of picture windows includes a bottom lip, which prevents photos or pictures from falling out from between an outer lampshade surface of the lampshade and an inner window surface of the respective one of the plurality of picture windows.

10. The lamp according to claim 9 wherein seated atop of the rotating bushing is a light socket.

11. The lamp according to claim 10 wherein the light socket includes light wiring that extends down through the inner circle of the rotating bushing, and inside of the vertical member; wherein the light socket is configured to receive a light bulb.

12. The lamp according to claim 11 wherein the vertical member includes a name plate affixed thereon; wherein the name plate is configured to receive indicia thereon; wherein the indicia being a name of an individual associated with the pair of baby shoes.

13. The lamp according to claim 12 wherein the motor includes a motor wire that extends from the motor to the first switch; wherein the first switch includes a switch wire; wherein both the switch wire and the light wiring connect at a junction; wherein an electrical cord connects to and extends from the junction; wherein the electrical cord extends from the base; wherein a plug is provided at a distal end of the electrical cord; wherein the plug is configured to interface with a standard electrical outlet.

* * * * *